US005743116A

United States Patent [19]

Suster

[11] Patent Number: 5,743,116

[45] Date of Patent: Apr. 28, 1998

[54] MULTI-LOCK HASP

[76] Inventor: Thomas Mitchel Suster, 91-939 Mailani St., Ewa Beach, Hi. 96706

[21] Appl. No.: 867,938

[22] Filed: Jun. 3, 1997

[51] Int. Cl.[6] ..... E05B 73/00

[52] U.S. Cl. ..... 70/14; 70/18; 70/DIG. 63

[58] Field of Search ..... 70/14–19, 21, 70/36, 37, DIG. 63; 292/282, 284

[56] References Cited

U.S. PATENT DOCUMENTS

| | | | |
|---|---|---|---|
| 1,136,735 | 4/1915 | Taylor | 70/19 |
| 1,376,114 | 4/1921 | Raney | 70/18 |
| 1,813,240 | 7/1931 | Joseph | 292/281 |
| 2,380,441 | 7/1945 | Howard | 248/150 |
| 2,963,895 | 12/1960 | Thomas | 70/18 |
| 3,667,259 | 6/1972 | Reque et al. | 70/14 |
| 3,834,195 | 9/1974 | Winkhaus | 70/8 |
| 3,858,923 | 1/1975 | Bunn | 292/281 |
| 4,085,599 | 4/1978 | Fischer et al. | 70/DIG. 63 X |
| 4,113,291 | 9/1978 | Cameron | 292/40 |
| 4,331,356 | 5/1982 | Noel | 292/281 |
| 4,697,443 | 10/1987 | Hillin | 70/DIG. 63 X |
| 5,020,342 | 6/1991 | Doan et al. | 70/DIG. 63 X |
| 5,070,712 | 12/1991 | Fox | 70/19 X |
| 5,365,757 | 11/1994 | Primeau | 70/DIG. 63 X |
| 5,400,622 | 3/1995 | Harmon | 70/14 |
| 5,582,042 | 12/1996 | Mordick | 70/DIG. 63 X |
| 5,673,574 | 10/1997 | Bertram | 70/18 |

FOREIGN PATENT DOCUMENTS

| | | | |
|---|---|---|---|
| 537560 | 5/1955 | Belgium . | |
| 187253 | 10/1956 | Germany . | |
| 503924 | 12/1954 | Italy | 292/281 |

*Primary Examiner*—Lloyd A. Gall
*Attorney, Agent, or Firm*—Patent & Trademark Services; Thomas Zack; Joseph H. McGlynn

[57] ABSTRACT

A multi locking hasp apparatus using two padlocks with lock keeper loops, two pivotally mounted jaws and a common back plate joined to the jaws at its pivotal mount. The free upper ends of each jaw engage holes in a hasp to lock the two members together as long as both padlocks remain locked in place. Should one of the two padlocks be unlocked and its keep loop removed from the jaw and back plate, the other padlock can be removed from the hasp's hole without unlocking it. This permits a series of secure areas or compartments to have a common lock with a common key or combinational lock while others may also unlock the other locks with individual keys or combinations.

3 Claims, 1 Drawing Sheet

MULTI-LOCK HASP

BACKGROUND OF THE INVENTION

Conventional lock and hasps are usually paired one lock to one hasp with the lock's keeper loop engaging the hasp. For many applications this has proven to be satisfactory. There are however, situations where many different locks each having its own key or combination to open them can produce a problem when one person may be responsible for obtaining access to the locked door, gate, locker or other secured area. This responsible person either has to have a large number of keys or combinations to fit each of the individual locks or a master key which opens all of the locks. When having a master key is not an option, the present invention allows a person to have one key that fits many identical keyed locks which are also locked with another lock having its own individual opening key different from the one key by providing for a multi locking hasp that can be opened when one of its two locks is opened as described herein.

DESCRIPTION OF THE PRIOR ART

Locks with engaging hasps are well known. In some as in U.S. Pat. No. 1,813,240 to Joseph, the lock and hasp are placed on the outside of a door while the door is not unlocked even if the hasp is removed. In other inventions, such as in U.S. Pat. No. 2,380,441 to Howard, the hasp is combined with clasp.

The Winkhaus reference (U.S. Pat. No. 3,834,195) uses a padlock carrier with a hasp and padlock to provide a secure locking mechanism. With the Bunn reference (U.S. Pat. No. 3,858,923) security is provided by mating the hasp parts in a tongue and groove arrangement with an upper protective plate. The Cameron security locking system (U.S. Pat. No. 4,113,281) uses a five-sided head of an operating shaft with a conventional door latch.

A hasp retaining device disclosed in the Noel reference (U.S. Pat. No. 4,331,356) uses arcuate spring like members between the end of the hasp staple. The Italian reference (503924) and the Germany patent 187253 to C. W. Cheney & son Ltd. both depict a spring actuated hasp with two separate rod axles each with their own springs. While the Belgium reference to S. Heijmans (537560) has a hasp with what appears to be two separate lock's keeper loop engaging apertures. The present invention differs from this prior art and the known prior art by providing for a multi locking hasp using two locks the unlocking of either will allow the opening of the locked device as more further set forth in this specification.

SUMMARY OF THE INVENTION

This invention relates to a multi locking hasp. Two substantially identical cam locking jaws are mounted by a pivot joint to a gang plate near one of their ends. There are apertures in each jaw to receive a lock which also extends through an aperture in the gang plate. The upper jaw ends each engage holes in a hasp to be locked in place. Should one of the locks in either jaw be removed, the pivotal action of that jaw permit its upper end to be removed from the hasp and both jaws released.

It is the primary object of the present invention to provide for an improved multi locking hasp apparatus.

Another object is to provide for such an apparatus wherein the unlocking of one jaw will permit the removal of the jaws even if the other remains locked.

These and other objects and advantages of the present invention will become apparent to readers from a consideration of the ensuing description and the accompanying drawings.

DESCRIPTION OF THE PREFERRED EMBODIMENT

Figure 1:
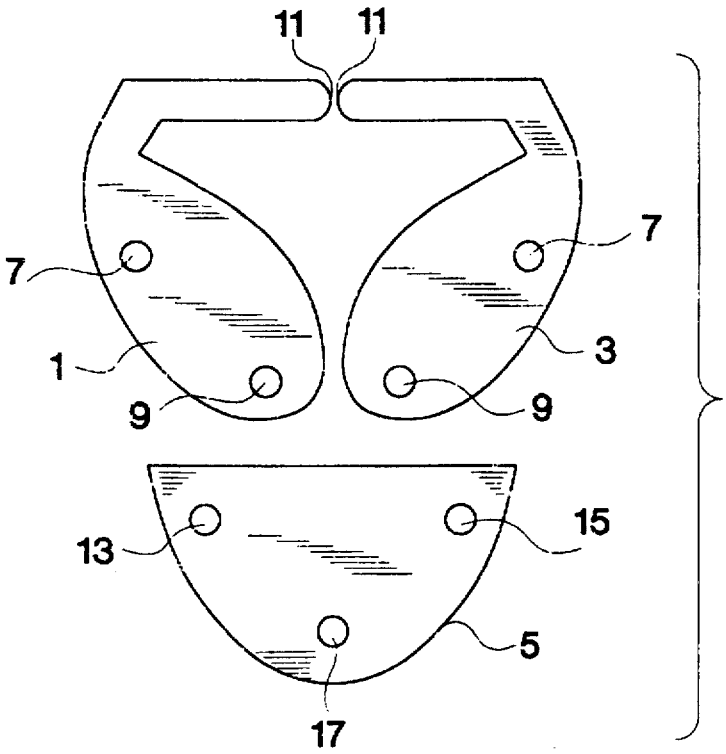
FIG. 1 is a front view of the invention's preferred embodiment.

FIG. 1 is a front view of the invention's preferred embodiment. The three major components making up the invention include two identical flat cam locking jaws 1 and 3 and the flat gang plate 5. Each of the jaws has two spaced holes 7 (upper) and 9 (lower) extending through the jaws. The upper holes 7 are dimensioned to receive lock's keeper loops of a conventional keyed or combination padlock. As will be described with respect to FIG. 3, the lower jaw holes 9 each receive a common pivot axle member which locks them in place relative to each other while permitting their pivotal motion. Near the upper ends of the jaws is a reduced narrower end 11 whose purpose is to fit within the aperture of a conventional lock hasp.

The lower semi-circular plate 5 has three separate holes 13, 15 and 17 extending through its flat surface. The upper holes 13 and 15 are positioned to align with the holes 7 in each jaw when the jaws are properly pivoted into position. The third lower hole 17 aligns with the two lower jaw holes 9 and receives the common fastening pivotal axle which passes through each hole.

Figure 2:
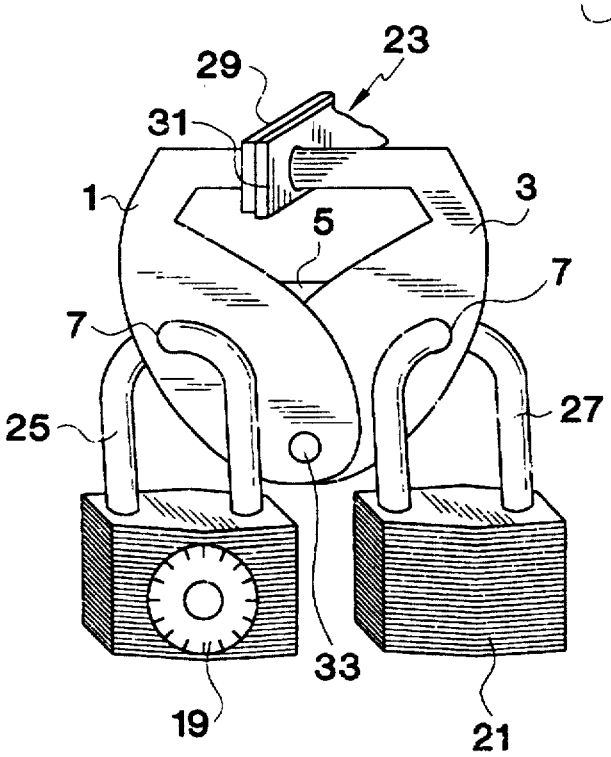
FIG. 2 is a front perspective view of the FIG. 1 embodiment with two separate locks and a hasp.

FIG. 2 is a front perspective view of the FIG. 1 embodiment with two separate conventional padlocks 19 and 21 and an upper holed hasp 23. Either of the padlocks may be either key operated or be combination locks, or both. In this illustration lock 19 is a combination lock and lock 21 a key operated lock. Each of the lock's keeper loops 25 and 27 are depicted in a closed locked position extending through the holes 7 in each jaw and the holes 13 and 15 in the gang plate 5 located to the rear of the jaws. The upper holed hasp 23 is shown as two separate members 29 and 31 that are desired to be locked together in an abutting relationship. For example, one of these members could be fixed to a door frame with the other member to the door desired to be locked. At the lower end of the two overlapping lock jaws the head 33 of the pin rivet 35 is shown.

Figure 3:
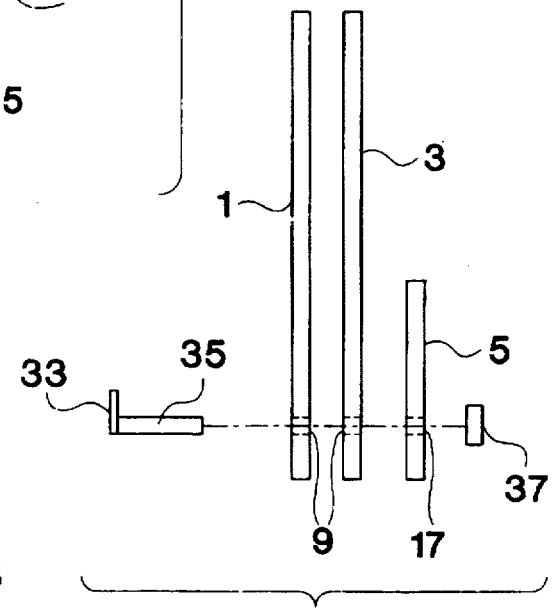
FIG. 3 shows an exploded side view of FIG. 1 components.

FIG. 3 shows an exploded side view of FIG. 1 components and the joining pin 35. The pin is sized to fit into the two aligned lower holes 9 of the overlapping jaws and the lower hole 17 in plate 5. An end pin retaining fastener 37 fits over the free end of the pin 35 to maintain the jaws and plate in their layered position while permitting the jaws to pivot much like the jaws of pliers. The upper free jaw end 11 can thus be adjusted in an arcuate manner to engage the holes in the two hasp members 29 and 31 to firmly hold them in place with respect to each other as long as the two locks 19 and 21 remain locked in place.

Should one of the two locks become unlocked and its keeper loop removed from the holes in the jaw and backup plate 5 its jaw end 11 can be removed from the hole in the hasp which permits the other locked jaw to also be removed by simply withdrawing its end 11 from the hasp's hole.

The uses of the invention should be apparent. Suppose emergency services personnel, fire, police, janitorial service or security personnel wish to maintain and control numerous security access areas. By having a common key or combination to one of the two locks they can enter any locked locker, door, gate or other compartment while the individual authorized to use the same may have their own individual key or combination lock to also enter their individual compartment or room, etc.. This eliminates the need for the security personnel from carrying multiple keys for each locker or door. If one of the locks had a common combination, then the other lock could have a different combination for each hasp desired to be locked in place.

The different jaws, plate components, and rivet pin can each be made of a hardened stainless steel, or tungsten carbide material to resistant corrosion and breakage. Different sized holes can be provided in different jaws and gang plate to accommodate the different cross sectional diameters of locks having large keeper loops which fit through them.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A multi-locking hasp apparatus comprising:

two jaws pivotally joined near their lower ends and having a reduced area upper hasp hole engaging end, each of said jaws having an upper hole therein extending through a jaw body and adapted to receive a lock keeper loop from a different lock; and a common back plate having two holes that can be aligned with each of the upper jaw holes, each of said plate holes being adapted to receive a lock keeper loop from a different lock and lock the jaw and the hasp hole engaging ends in place with respect to the plate and an engaged hasp hole; wherein said jaws are pivotally joined together by a pivot pin which extends through both jaws and the common back plate.

2. The apparatus as claimed in claim 1, wherein said pivot pin has an enlarged head with an end fastener on its other end.

3. The apparatus as claimed in claim 2, wherein said jaws are flat and substantially identical in shape and said back plate is a flat plate.

* * * * *